US006325323B1

(12) United States Patent
Olsson

(10) Patent No.: US 6,325,323 B1
(45) **Date of Patent: *Dec. 4, 2001**

(54) MEANS FOR CONTROLLING THE NIP FORCE IN A REEL-UP GEAR MACHINE

(75) Inventor: Anders Olsson, Karlskoga (SE)

(73) Assignee: Thermo Nobel AB (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/230,342

(22) PCT Filed: Dec. 18, 1996

(86) PCT No.: PCT/SE96/01694

§ 371 Date: Jan. 25, 1999

§ 102(e) Date: Jan. 25, 1999

(87) PCT Pub. No.: WO97/22543

PCT Pub. Date: Jun. 26, 1997

(30) Foreign Application Priority Data

Dec. 20, 1995 (SE) ..... 9504559

(51) Int. Cl.[7] ..... B65H 18/14
(52) U.S. Cl. ..... 242/541.7; 242/542.3
(58) Field of Search ..... 242/541.7, 542.3, 242/541.4

(56) References Cited

U.S. PATENT DOCUMENTS

| | | | |
|---|---|---|---|
| 3,743,199 | 7/1973 | Karr et al. | 242/65 |
| 4,634,068 | 1/1987 | Malkki et al. | 242/65 |
| 4,742,968 | 5/1988 | Young, Jr. et al. | 242/65 |
| 5,611,500 * | 3/1997 | Smith | 242/541.4 |

FOREIGN PATENT DOCUMENTS

| | | |
|---|---|---|
| 0 538 221 B1 | 4/1993 | (EP) . |
| 0 604 558 B1 | 7/1994 | (EP) . |
| 0 611 362 B1 | 8/1994 | (EP) . |
| 0 496 863 B1 | 11/1995 | (EP) . |
| 0 697 006 B1 | 2/1996 | (EP) . |
| 0 642 460 B1 | 9/1996 | (EP) . |
| WO 93/24401 | 12/1993 | (WO) . |
| WO 95/21118 | 8/1995 | (WO) . |
| WO 96/06033A1 | 2/1996 | (WO) . |

OTHER PUBLICATIONS

Application Case AC–4–2 Presure Control in Reel–Up Gear, 1981, 5 pp., Bofors Electronik, Bofors, Sweden.
Pressure Control in Reel–Up Gear RPC–1, 1984, 4 pp. Nobel Elektronik, Karlskogo, Sweden.
Swedish Newspaper "Svensk Paperstidning" nr 6, 1979—"Linjetrycket i rullstolen regleras med nytt system", p. 153.

* cited by examiner

*Primary Examiner*—John Q. Nguyen
(74) *Attorney, Agent, or Firm*—Connelly Bove Lodge & Hutz, LLP

(57) ABSTRACT

The invention relates to a nip force control system in a reel-up gear for a paper machine comprising a pair of primary arms (6, 7) and secondary arms (8, 9) for supporting and positioning a tambour core (2, 3) at the paper web winding operation as well as at the so-called change-over procedure when the tambour core is replaced. Each of the arms are connected to a hydraulic cylinder (10, 11) for positioning the arms and the primary—as well as the secondary arms are provided with load cells (12, 15) for measuring the nip force (F) for respective arm against the tambour core (2, 3). The control system also includes load cells (17) in the holding bracket (4) of the tambour core for measuring the additional force from said holding bracket. By this location of the load cells close to the measuring point an improved nip force control is obtained, especially during the critical change-over procedure.

9 Claims, 4 Drawing Sheets

MEANS FOR CONTROLLING THE NIP FORCE IN A REEL-UP GEAR MACHINE

FIELD OF THE INVENTION

Figure 1:
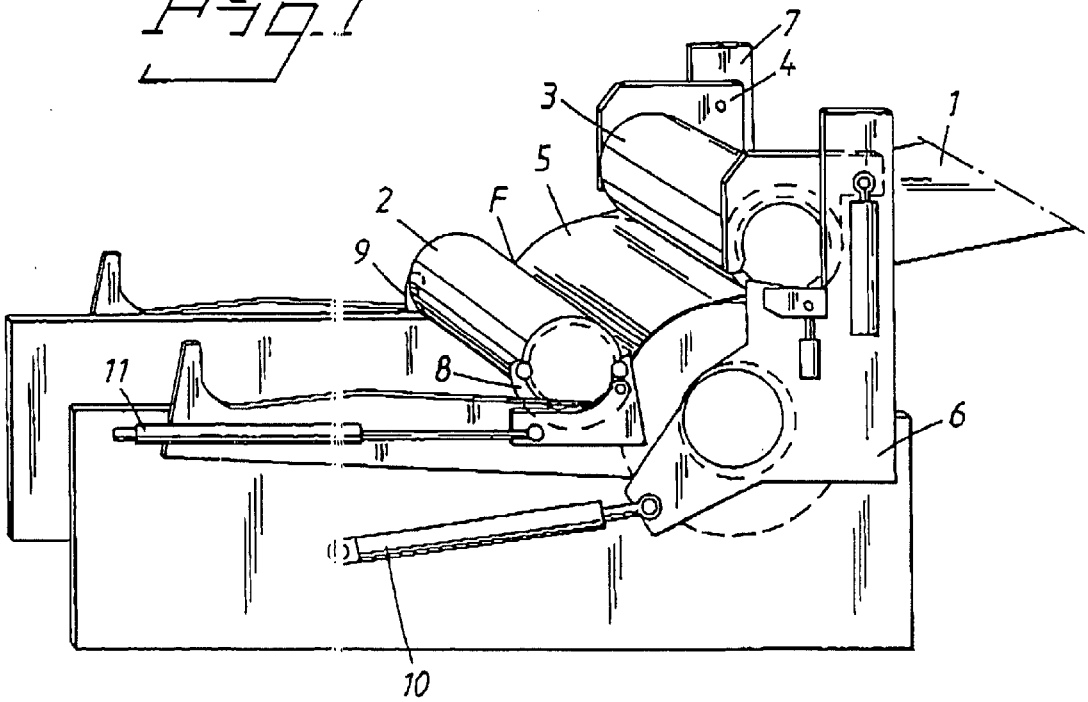

The present invention relates to means for controlling the nip force in a reel-up gear machine for paper manufacturing, said reel-up gear machine having primary arms as well as secondary arms for position control when changing from a webbed-up tambour to a new tambour during continuous web winding operation.

BACKGROUND OF THE INVENTION

In modern paper machines the paper is manufactured in a continuously traveling web. The paper web width might be as much 10 m and the web is traveling at high speeds such as 1000 m/min and more and the length of the paper machine itself might be over 100 m.

In a paper machine of this type a paper suspension is initially supplied to the inlet box of the machine and on its passage through the machine the paper suspension is dehydrated, pressed, dried and so on to a continuous paper web which is finally winded up on rolls in the reel-up gear.

Existing paper machines are operated continuously and they are controlled by computers. From a number of measuring points current operating parameters for the paper such as pressure, temperature, surface weight, thickness, humidity and so on, are supplied to the computer. Based on these parameters the computer is controlling the paper manufacturing process by adjusting valve condition, machine speed and the like so that a high quality of the produced paper web can be maintained.

As a modern paper machine might produce as much as 250 000 ton of paper a year and the cost for such a machine is about 2 billion Swedish crowns it should be understood that is very important to monitor the quality of the paper produced by the machine during the entire manufacturing process. An interruption or other breakdown in production might give rise to very serious economical consequencies.

One critical phase in the paper making process is the change-over procedure from a webbed-up tambour to a new, empty tambour in the reel-up gear during the continuous winding. Even if the pressure of the rolls have been continually monitored also in previous available systems usually the first few meters of the web on the new roll have been damaged.

Probably the most important parameter in paper winding is the nip force which is the force between the tambour and the pope. In existing systems this force has been measured indirectly by means of a number of pressure transducers used for controlling the pressure in the hydraulic system of the machine. Measuring this pressure, however, does not give an accurate value of the real nip force. This depends on the fact that during the change-over procedure when the rolls are changed a number of adjustments are made to switch the paper web to the new tambour and during these adjustment operations comparatively big alterations in the nip force level might occur and which cannot always be compensated for by the pressure control system.

The change-over procedure for a paper roll can be divided into a number of phases or positions, such as (1) a reeling phase for winding the paper web to a completed tambour, (2) a loading position in which a tambour is completed and the new tambour core is brought into its wound roll winding position, (3) a change-over position in which the completed tambour is removed and the paper web is switched over to the waiting tambour core, and (4) a delivery position in which the tambour is switched over from the primary arms to the secondary arms.

The reels are positioned by means of so-called primary- and secondary arms. In present pressure control systems it has been difficult to accurately control the position of the arms during the different phases. This depends on the fact that the pressure transducers have been located on a distance from the arms in the control system.

SUMMARY OF THE INVENTION

One object of the present invention is to provide an improved means for controlling the nip force in a reel-up gear for a paper machine.

A further object of the invention is to provide a repetitive and controlled operation during the change-over procedure when the completed tambour is replaced.

According to the invention the primary arms as well as the secondary arms are provided with load cells for measuring the nip force directly against the tambour core and this measurement is then used for controlling the nip force so that it is maintained within a specific range.

Figure 2:
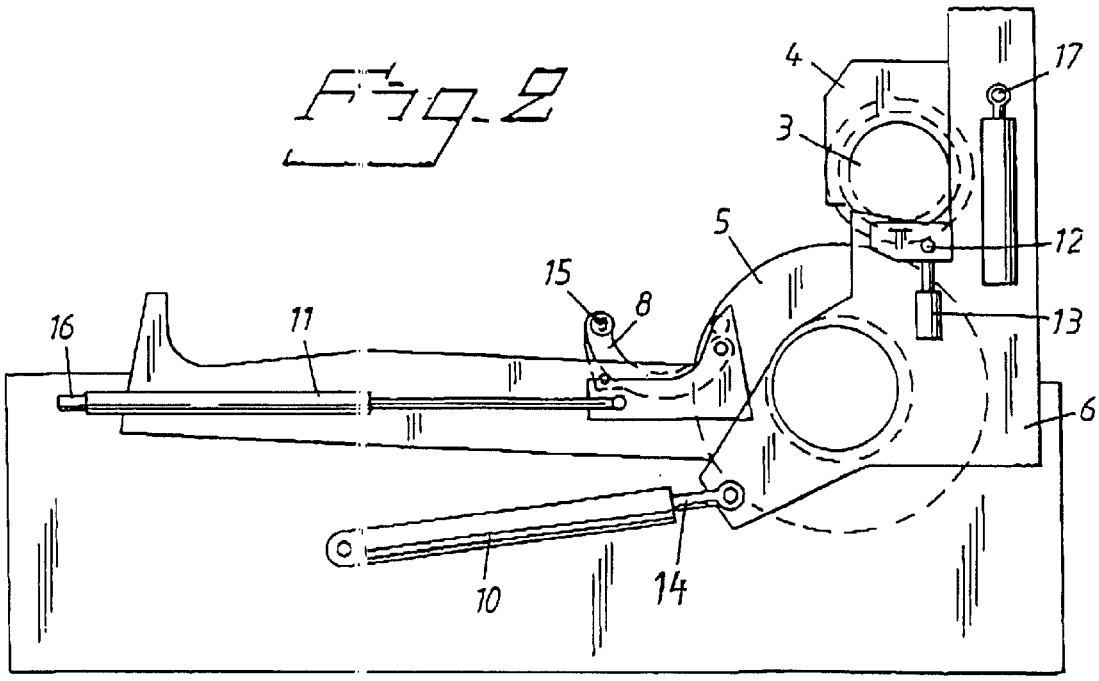
Figure 3:
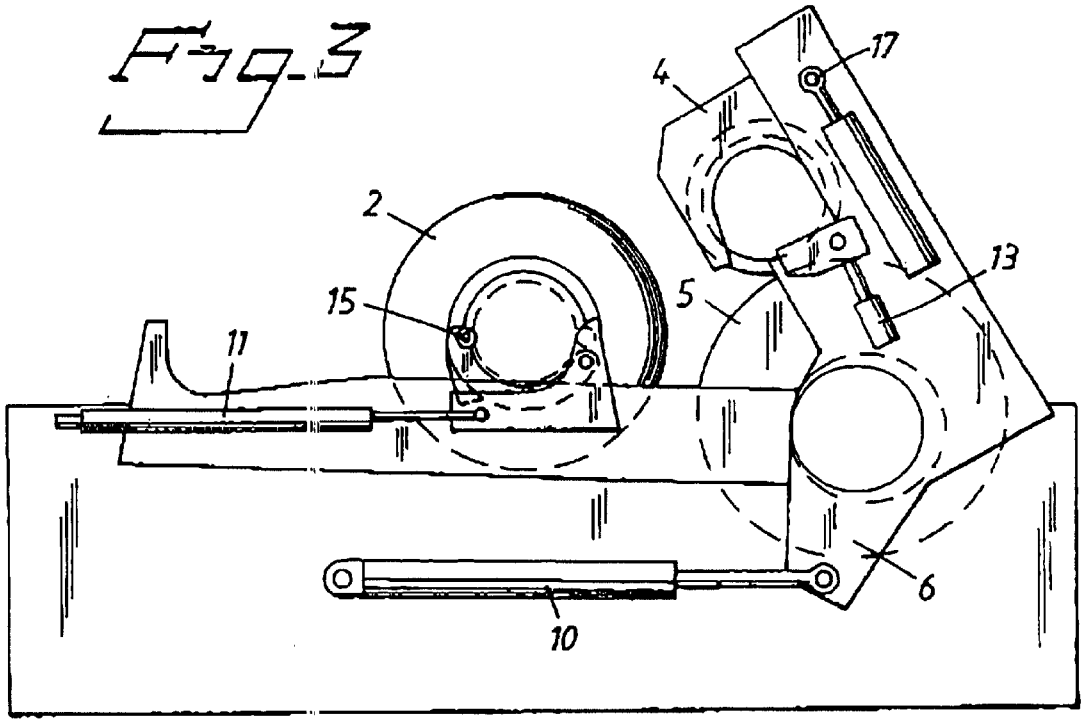
Figure 4:
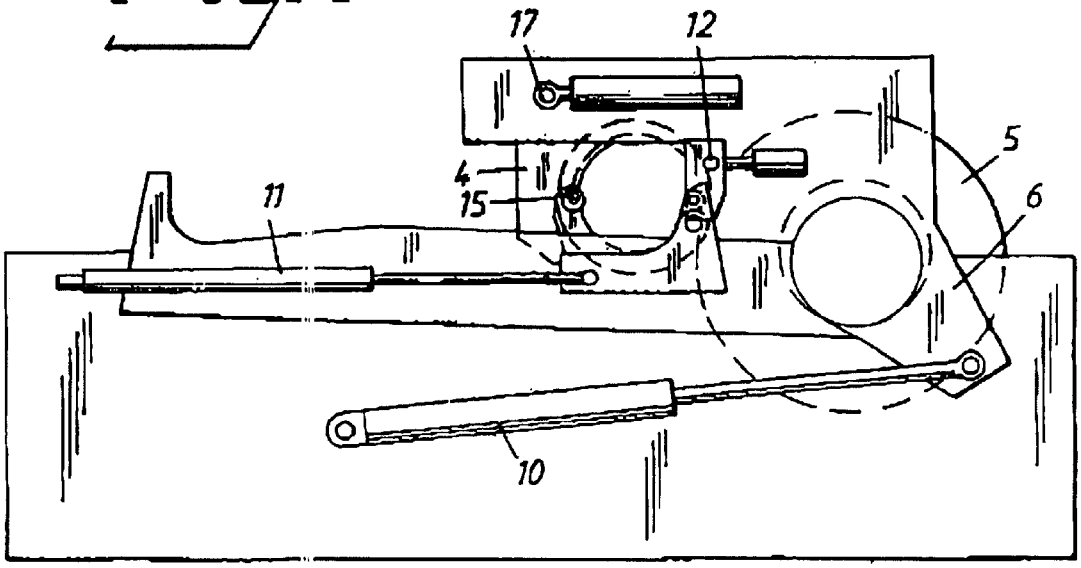
Figure 5:
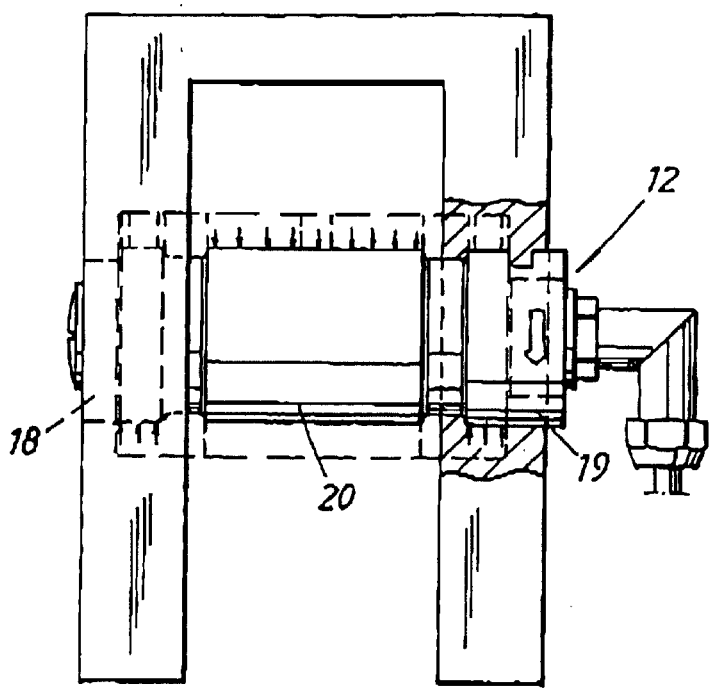
Figure 6:
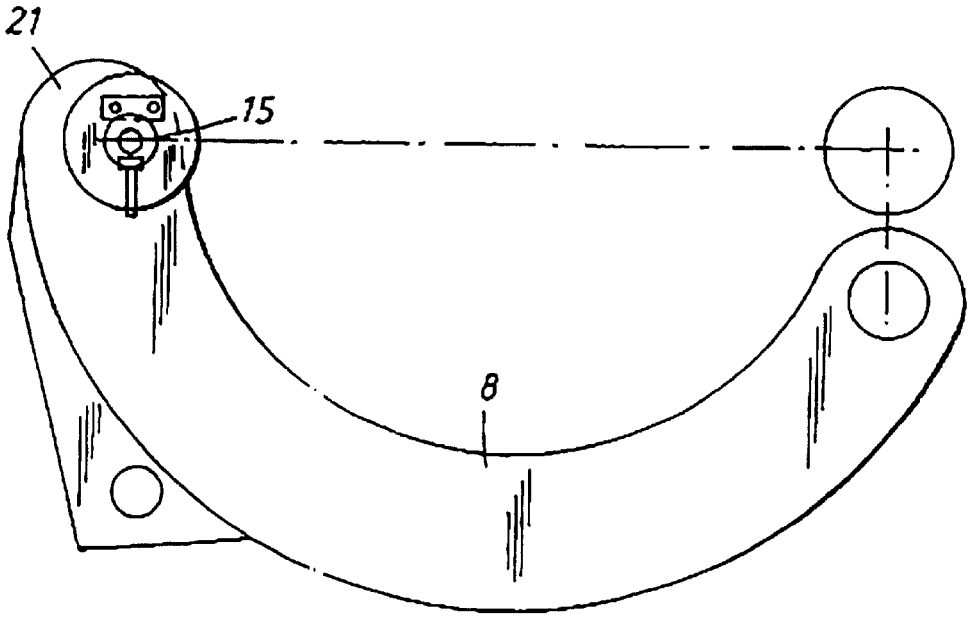
Figure 7:
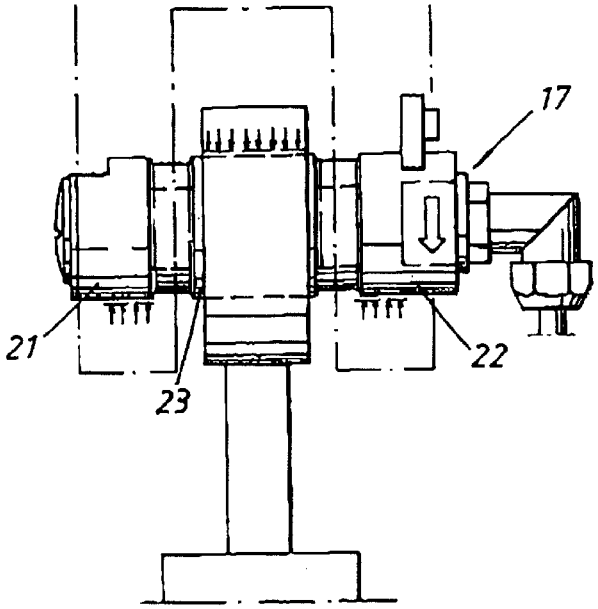
Figure 8:
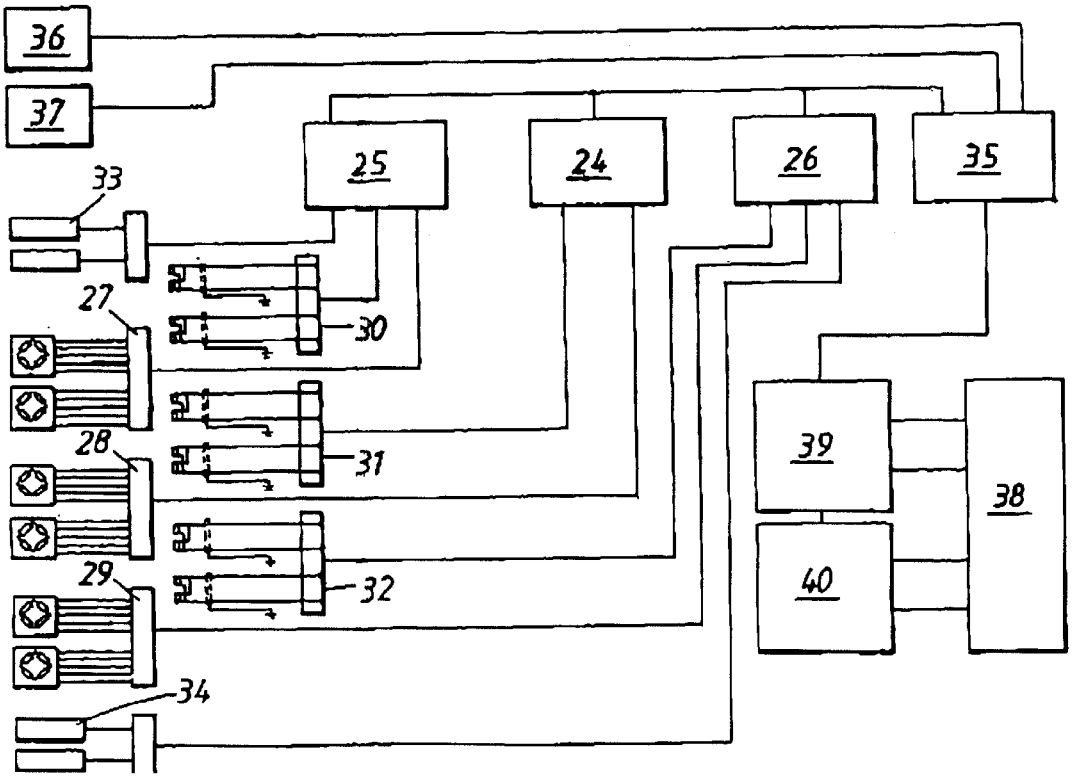

In the following the invention will be described more in detail in connection with the accompanying drawings which illustrate one embodiment for controlling the nip force in a reel-up gear for a paper machine, wherein FIG. 1 is a schematic view of a conventional reel-up gear for a paper machine, FIG. 2 is a side-elevational view of a part of the reel-up gear in the initial loading position, FIG. 3 is a side-elevational view of a part of the reel-up gear in the change-over position, FIG. 4 is a side-elevational view of a part of the reel-up gear in the delivery position, FIG. 5 illustrates more in detail with the location of load cells in the primary arms/lifting cylinders, FIG. 6 illustrates the location of load cells in the secondary arm, FIG. 7 illustrates the location of load cells in the holding bracket, and FIG. 8 is a block diagram of the nip force control system.

DETAILED DESCRIPTION OF THE INVENTION

FIG. 1 illustrates schematically a conventional reel-up gear for a paper machine. The reel-up gear is the end station of a paper machine in which the paper web is wound onto a tambour core. In the figure it is illustrated how a continuous paper web 1 is wound onto a tambour core to a completed so-called tambour 2, and a new, empty tambour core 3 is located in a waiting position in the holding bracket 4 of the reel-up gear ready to take over as soon as the first tambour is completed. The tambour 2 is in engagement with the so-called pope 5 and the force between these two rolls, the nip force F, is an important parameter for the quality of the paper as already mentioned.

FIG. 1 also illustrates the supporting and positioning devices for the tambour core which devices are movable in order to effectuate the change of a tambour during the change-over procedure. Said devices comprise a couple of primary arms 6,7 and a couple of secondary arms 8,9 for supporting the tambour 2. The position of the respective arms are controlled by hydraulic cylinders 10, 11, one for each arm.

As already mentioned in the introductory portion of the specification a paper web 1 in a modern paper machine might have a width of 10 m and the weight of a completed roll might be 50 ton. Such a weight together with the fact that the travelling speed of the paper web is about 1000 m/min is an important reason to maintain the nip force within a prescribed range. Under normal reeling this nip force control is no problem, but there is a critical phase when the tambour is replaced, during the so-called change-over phase of operation. In order to maintain a prescribed quality of the paper through the entire roll the nip force must be accurately controlled also during this phase. The change of tambour is effectuated by means of said primary- and secondary arms and this will be described more in detail in connection with FIGS. 2, 3 and 4.

According to the invention the nip force is measured by means of load cells which are located in the primary arms as well as in the secondary arms and the load cells are used for the control of the nip force. The change-over procedure between the primary arms and the secondary arms is also controlled by said load cells together with a load cell located in the holding bracket of the tambour core in order to maintain the nip force within a prescribed range also during this critical phase of operation. Position sensors in the secondary arms together with a paper roll diameter measuring apparatus is used for providing a repetitiv and controlled operation at the contact and change-over procedure between the secondary- and primary arms.

In the FIGS. 2, 3 and 4 different phases during the change-over operation is illustrated in a side-elevational view of the components for controlling the nip force. The figures show the primary- and secondary arms, hydraulic cylinders and the location of the load cells on one side of the reel-up gear and it should be understood that a corresponding arrangement of these parts is located on the other side of the reel-up gear. The nip force of the primary arms 6 is measured by means of load cells 12 and the force is controlled through lifting cylinders 13 wherein the pressure is controlled by individual servo valves. The position of each of the primary arms is measured and controlled by individual position sensors 14 with its hydraulic cylinders 10 so that the lowering of the empty tambour core 3 is parallel.

The nip force of the secondary arms is also measured by load cells 15 located so that the force is measured directly against the tambour 2. The force is controlled through cylinders 11 wherein the pressure in each of the cylinders is controlled by a servo valve. The position of the secondary arms is also measured by individual position sensors 16 so that a parallel placement is achieved against the tambour core 2.

The desired nip force values for the operation are entered by means of preestablished menues that can be modified by the operator within specific ranges. The system can be provided with a screen on which a number of operational curves are displayed and can be compared in order to analyze for instance the quality of the paper. The system can for instance be connected to a network in which various operating parameters can be printed out.

The system is preferably adapted to be completed by equipments for density measuring,for proving frame signals, length measuring, nip force adjustment and adjustment of the pope signal within a predetermined range. Such additional equipments are commercially available and will not be described in any detail here.

The load cells 12 of the primary arms are located directly on the arm close to the measuring point. The load cells are preferably of the cylindric type sold by Nobel Elektronik under the name KOSD 40 which are easy to install in the existing primary- and secondary arms, respectively. In the primary arm then, the existing shaft in the lifting cylinder 13 of the arm has been replaced with such a load cell. A KOSD 40 load cell comprises three sections where the two outer sections have a supporting function and the central section is loaded. The load cell is made with resistive strain gauges and is based on the shear force principle which makes the load cell well suited for overloading and insensitive to side forces.

In the secondary arm there is normally a shaft with a bearing adapted to roll against the tambour core. According to the invention this shaft has been replaced with a load cell 15 so that a direct measurement against the tambour core 2 is obtained, i.e. in direct connection with the measuring point. Even in this case a KOSD 40 load cell is well suited for use.

A third pair of load cells 17 are arranged in the holding bracket 4 for measuring the nip force so that a controlled removal of the holding bracket is obtained after the change-over operation.

FIG. 2 shows the initial loading situation when the tambour is completed and the new tambour core is moved into position for reeling. In this situation the secondary arms are in their forward positions and the primary arms in their upper/rear positions and a signal in the system indikates "ready for placing a new tambour core".

When the tambour core has been placed and the holding bracket positioned on the core the operator makes a signal to the system. Then the system makes an automatic taring of the load cell to compensate for different weights of the tambour core.

When the taring has been carried out an output signal indicates that the system is calibrated and in its waiting position. The operator then indicates when the primary arms should be brought to its roll winding position as is illustrated in FIG. 4. The primary arm starts to wind the paper when it is located in its upper position until a signal is provided to the secondary arms in their "forward positions" to start the lowering operation. The individual positions of the primary arms are measured by two position sensors when they are lowered, which sensors provide signals representing the position and the system is controlling the nip force during the entire lowering operation.

The positions of the secondary arms are also measured by the two position sensors 16 so that speed and position can be controlled. Then a parallel placement against the tambour core is achieved as is shown in FIG. 3. As soon as the load cells are sensing the force against the tambour core the nip force control is initiated. The two load cells 15 mounted on each sides of the secondary arms are measuring the force against the tambour core. When the force control has started the force is increased corresponding to a given ramp to its preestablished value at the same time as the nip force of the primary arm is correspondingly decreasing. When the change-over operation is ready a signal is obtained which indicates that connection has been obtained and the primary arm is raised, see FIG. 2.

FIG. 5 shows a KOSD-40 load cell 12 which is built into the lifting cylinder of the primary arm in such a way that the two outer supporting sections 18 and 19 of the load cell is resting against the tambour core, while the central section 20 is loaded by the cylinder. The load cell 12 replaces the existing shaft in the primary arm. By such a location of the load cell a nip force measurement directly against the primary arms is obtained.

FIG. 6 shows a KOSD-40 load cell 15 built into one end 21 of the curved secondary arm in which the load cell replaces the existing bolt or shaft for the roll bearing. The two supporting sections are in this case resting against the upper fork shaped portion while the central section, the measuring section, is loaded by the roll. By this location of the load cell a nip force measurement of the secondary arms directly against the tambour core is obtained as soon as this is in contact engagement with the secondary arms at the delivery phase.

In FIG. 7 it is finally illustrated a KOSD-40 load cell 17 built into the holding bracket. The purpose of this load cell is to measure the holding bracket force and compensate for this force at the change-over removal operation. The two supporting sections 21, 22 of the load cell is in contact engagement with the holding bracket while the central section 23 is in contact engagement with the cylinder.

FIG. 8 is a block diagram of the nip force control system. The system comprises control modules 24, 25 for the primary arms and a control module 26 for the secondary arm. The control modules are connected to both sides servo valves 30, 31, 32 and both sides load cells 27, 28 and 29. The control modules 25 and 26 are also connected to position sensors 33, 34.

The control modules are connected together to a superior control module 35 with input connections for a set point adjustment 36 and service 37. Also, a suitable external equipment 38 is connected, via external in- and output components 39, 40, to the superior control module 35.

The system operates in the following way. The desired value is set through preestablished menues and can be modified by the operator within a specific range. A basic linearisation is included in the system which takes into account the weight of the tambour core+the paper roll including frictions. The desired value is chosen by the operator according to a pre-programmed table, for example increase or decrease of nip force, inclination and difference between the sides of the roll.

In practice the desired value is entered on a panel on which a number of menues are available for the operator. The nip force can be set to 3 kN/m and the operator can then regulate the nip force in steps of 0.1 kN/m. The operator can then decide a higher or lower nip force when the paper is webbed up. Such adjustment can for instance be made in steps of 0.1 kN/m and the operator can also adjust any difference between the sides of for instance 0.1 kN/m.

The nip forces of the primary- and secondary arms are measured by means of the load cells 27, 28 and 29 and signals are supplied to the respective control module 24, 25 and 26. The actual signals are compared with the given signals in the control modules and the nip force is controlled via the cylinders wherein the pressure is controlled by the servo valves 30, 31 and 32.

The position sensors 33 are measuring the position of the primary arms and the position signals are compared in the control module 25 and any difference alters the position of the primary arms so that a parallel lowering is obtained. In a corresponding manner the position sensors 34 are measuring the position of the secondary arms and the position signals are supplied to the control module 26 for altering the positions of the secondary arms so that a parallel placement is achieved when aging a tambour core.

The external equipment 38 may comprise means for density measurement, proving frame measurement length measurement or the like. It also comprises suitable devices for displaying curves of the paper quality as well as terminals for connection to networks for print-out of various operational parameters in the system.

The specific control modules and other control system components are not described in any detail here as they are commercially available or can easily be modified to any specific requirements that exist for the paper machines by the expert in the field. The new and characterizing feature of this system is the arrangement of load cells for measuring the nip force in which the load cells are located on the primary- and secondary arms in such a way that the measurement is carried out directly against the tambour core. This gives a very high and repetitive control accuracy in the system also during the critical change-over procedure between the secondary- and primary arms as well as during removal of the holding bracket.

The invention is not limited to the example described in the specification for measuring the nip force but can be varied within the scope of the accompanying claims.

What is claimed is:

1. Arrangement for controlling the nip force in a reel-up gear in a paper machine, including a pair of primary arms (6,7) and secondary arms (8,9) for supporting and positioning a tambour core (2,3) at the paper web winding operation as well as at the change-over procedure when the tambour core is replaced and wherein each of said arms being connected to an hydraulic cylinder (10,11) for altering the respective positions of the arms, the primary arms (6,7) as well as the secondary arms (8,9) includes load cells (12,15) for measuring the nip force (F) for the respective arms against the tambour core (2,3) and controlling said nip force to be maintained within preestablished limited characterized in that the position of the primary arms (6,7) is measured and controlled by individual first position sensors (14) with hydraulic cylinders (10) for a parallel lowering of the tambour core (3), that the position of the secondary arms is measured by individual second position sensors (16) for a parallel engagement with the tambour core (2) and that in addition to the load cells (12,15) in the primary- and secondary arms of the reel-up gear the control system also includes a pair of holding bracket force load cells (17) in a holding bracket (4) of the tambour core for measuring the additional force from said holding bracket, and the holding bracket force load cells being in contact engagement with the holding bracket and in contact engagement with the pressure cylinder for the holding bracket force load cell.

2. Arrangement according to claim 1 characterized in that the load cell (12) of each primary arm is mounted directly on the arm, close to the measuring point.

3. Arrangement according to claim 2 characterized in that the load cell (15) of each secondary arm is built into one end (21) of the curve-shaped secondary arm (8,9), for measuring the secondary arm nip force directly against the tambour core (2,3) when the core comes into contact engagement with the tambour core at the change-over operation.

4. Arrangement according to claim 3 characterized in that each secondary arm load cell (15) is mounted in a roll bearing of each respective secondary arm such that a direct measuring against the tambour core is obtained in order to obtain a controlled and repetitive paper web reeling.

5. Arrangement according to claim 2, wherein each primary arm load cell is mounted in a lifting cylinder of the primary arm.

6. Arrangement according to claim 1 characterized in that the load cells (12,15,17) are of a cylindrical shear force type with resistive strain-gauges.

7. Arrangement according to claim 6 characterized in that a third position sensor (33) is connected to none of the control modules (25) for the primary arms for controlling the position of the primary arms so that said parallel lowering can be achieved and a fourth position sensor (34) is connected to the control modules (26) for the secondary arms for controlling the position of the secondary arms so that said parallel engagement with the tambour core is obtained.

8. Arrangement according to claim 6 characterized in that said load cells (reference numerals 27, 28 and 29 in FIG. 8) are connected to individual control modules (24,25,26) for the primary- and secondary arms, which control modules are connected to a superior control module (35) with input terminals for entering specific operational parameters (36) and service (37).

9. Arrangement according to claim 6, wherein the resistive strain gauges of the load cells are of the type KOSD-40.

* * * * *